US011243051B2

(12) United States Patent
Roux

(10) Patent No.: US 11,243,051 B2
(45) Date of Patent: Feb. 8, 2022

(54) BALLISTIC PROTECTION SYSTEM AND METHOD THEREFOR

(71) Applicant: Phillip D. Roux, Phoenix, AZ (US)

(72) Inventor: Phillip D. Roux, Phoenix, AZ (US)

( * ) Notice: Subject to any disclaimer, the term of this patent is extended or adjusted under 35 U.S.C. 154(b) by 0 days.

(21) Appl. No.: 16/922,425

(22) Filed: Jul. 7, 2020

(65) Prior Publication Data

US 2021/0285744 A1 Sep. 16, 2021

Related U.S. Application Data

(60) Provisional application No. 62/871,340, filed on Jul. 8, 2019.

(51) Int. Cl.
*F41H 5/04* (2006.01)
*F41H 5/02* (2006.01)

(52) U.S. Cl.
CPC *F41H 5/04* (2013.01); *F41H 5/02* (2013.01)

(58) Field of Classification Search
CPC ..... F41H 5/00; F41H 5/02; F41H 5/04
USPC ..... 89/36.02
See application file for complete search history.

(56) References Cited

U.S. PATENT DOCUMENTS 619,295 A * 2/1899 Flodquist ..... F41H 5/02 114/11
848,024 A * 3/1907 Gathmann ..... B63B 3/10 114/10
1,035,573 A * 8/1912 Gathmann ..... B63B 3/10 114/10
1,438,109 A * 12/1922 Hale ..... F41H 5/08 109/49.5
1,625,061 A * 4/1927 Trout ..... B23K 11/002 428/593
2,332,464 A * 10/1943 Pissarevsky ..... F41H 5/0492 109/81
3,398,406 A * 8/1968 Waterbury ..... F41H 5/04 2/2.5
3,636,895 A * 1/1972 Kelsey ..... F41H 5/023 109/78
5,149,910 A * 9/1992 McKee ..... F41H 5/023 109/82
7,415,806 B2 * 8/2008 Davidson ..... E04H 9/10 109/49.5
7,597,040 B2 * 10/2009 Gabrys ..... B32B 3/18 89/36.02
8,132,495 B2 * 3/2012 Joynt ..... F41H 5/007 89/36.08
8,468,926 B2 * 6/2013 Treadway ..... F41H 5/023 89/36.02
8,646,373 B1 * 2/2014 Kucherov ..... F42D 5/05 89/36.11
8,746,122 B1 * 6/2014 Roland ..... F41H 5/0414 89/36.02
8,757,041 B1 * 6/2014 Gillen ..... F41H 5/045 89/36.02
9,207,048 B1 * 12/2015 Roland ..... F41H 5/007
9,944,041 B1 * 4/2018 Iliev ..... B32B 7/12
(Continued)

*Primary Examiner* — Joshua E Freeman
(74) *Attorney, Agent, or Firm* — Weiss & Moy, P.C.; Jeffrey D. Moy

(57) ABSTRACT

A ballistic panel providing ballistic protection has a first plate having a rear surface and a front surface. A plurality of undulations is formed across the front surface of the first plate. The plurality of undulations increasing an amount of surface area to contact a projectile.

8 Claims, 4 Drawing Sheets

(56) References Cited

U.S. PATENT DOCUMENTS

| | | | | |
|---|---|---|---|---|
| 10,274,289 | B1 * | 4/2019 | Barnhart, II | F41H 1/02 |
| 10,648,777 | B2 * | 5/2020 | Bailey | F41H 5/0407 |
| 2004/0237763 | A1 * | 12/2004 | Bhatnagar | F41H 5/0485 89/36.02 |
| 2007/0272911 | A1 * | 11/2007 | Fromm | F41H 11/08 256/65.14 |
| 2008/0236378 | A1 * | 10/2008 | Sane | F41H 5/0492 89/36.02 |
| 2009/0047482 | A1 * | 2/2009 | Starke | B64C 3/28 428/182 |
| 2009/0114083 | A1 * | 5/2009 | Moore, III | F41H 5/0492 89/36.02 |
| 2009/0252982 | A1 * | 10/2009 | O'Keefe | G02B 19/0033 428/573 |
| 2010/0212484 | A1 * | 8/2010 | Williams | F41H 5/0421 89/36.02 |
| 2011/0174143 | A1 * | 7/2011 | Sanborn | F41H 5/023 89/36.02 |
| 2012/0168702 | A1 * | 7/2012 | Fromm | E01F 13/12 256/13.1 |
| 2013/0160640 | A1 * | 6/2013 | Livesey | F41H 5/023 89/36.02 |
| 2016/0161222 | A1 * | 6/2016 | Lee | A42B 3/14 2/416 |
| 2019/0323801 | A1 * | 10/2019 | Bright | E04C 2/3405 |
| 2020/0033097 | A1 * | 1/2020 | Speyer | B32B 27/365 |

* cited by examiner

BALLISTIC PROTECTION SYSTEM AND METHOD THEREFOR

TECHNICAL FIELD

The present application relates generally to an armor systems, devices and methods, and more specifically, to ballistic protection systems, devices, and related methods that utilize a channel design to deflect projectiles in order to increase yaw and decrease penetration.

BACKGROUND

Armor has been used for years in order to protect personnel and equipment from damage due to projectiles. More specifically, body armor has become an essential piece of safety equipment to protect military personnel, police, security personnel as well as private citizens against various dangerous threats such as penetrating attacks by weapons, slashing, bludgeoning, etc.

Presently, there are several different types of body armor. For example, there are different types of body armor to provide protection against attacks using cutting tools or weapons such as knives, swords, axes, broken bottles, and the like, commonly referred to as edge blade protection device/system. Others may be designed to provide protection against objects like long nails, needles, ice picks, screwdrivers, stilettos and the like, commonly referred to as spike protection device/systems. However, ballistic protection is the most common type of body armor and is generally referred to as "bulletproof vest" and/or "bullet resistant armor" as these types of body armor provides resistance to projectiles/bullets.

In traditional body armor ballistic protection systems, the quality of the system is directly correlated to the outcome of the individual (e.g., from as little as a soft bruise to blunt force trauma to a bullet wound to death). The type of bullets resisted is generally based on the categorized level of the armor.

Ballistic protection armor can be categorized as Level IIA, Level II, Level IIIA, Level III, or Level IV armors. Levels HA to Level IIIA armors are designed to offer protection against most of the commonly available firearms such as 9 mm, 0.357 magnum, and 0.44 magnum firearms. Bulletproof vests at these levels use soft materials like Kevlar, which is strong and can trap and slow bullets to a complete stop.

Higher ballistic armors of levels III and IV are designed to provide protection against large, high-velocity bullets such as from rifles and submachine guns. Body armors at these levels are in a form of hard rigid ballistic plates. The ballistic plates are generally incorporated into the vests or plate carriers. The ballistic plates are designed to stop rounds both from penetrating soft body armor and entering the body as well as protecting the users from blunt trauma associated with the dissipation of the high energy generated by a round striking the body.

Typically, ballistic plates vary in size, material and design with each offering trade-offs regarding performance, weight and other factors. Some may be made of steel or hardened steel or aluminum which are generally relatively effective at stopping projectiles and are relatively inexpensive, but are relatively heavy and can be uncomfortable to wear for long periods of time. Other ballistic plates/protection systems are made of multiple compressed sheets of fiber such as polyethylene that are designed to cause the bullet to become trapped within the layers. This design requires a sufficient number of woven and/or laminated fiber layers so as to prevent the projectile from penetrating all the way through the layers. This design offers a lighter weight relative to steel but is more expensive and involves a more complicated manufacturing process. Another material that is in common use for ballistic plates is a ceramic or glass plates that are compressed together and are designed to cause the projectile to disintegrate or deform upon impact. This design also offers a weight advantage over the heavy steel plates, however, once impacted, that area of the ceramic is generally no longer effective and offers no secondary protection from a second projectile impacting the same area.

In all of the aforementioned plate designs, regardless of material, the ballistic protection systems employ essentially a "plate" design, that is a relatively flat configuration designed to stop a bullet striking the plate head on. Current ballistic plate designs focus on preventing the bullet from penetrating the ballistic plate the way an arrow would penetrate a target. However, projectiles come in various shapes and sizes (i.e. calibers) and are capable of striking a ballistic protection system from any angle regardless of material.

Therefore, it would be desirable to provide a ballistic protection system and method that overcomes the above. The ballistic protection system and method would offer maximum protection regardless of the angle of impact of the projectile. The ballistic protection system and method would be able to deflect and stop projectiles regardless of their impact angle in order to maximize the protection to an individual wearing the ballistic protection system.

SUMMARY

In accordance with one embodiment, a ballistic panel providing ballistic protection is disclosed. The ballistic panel a first plate member having a rear surface and a front surface. A plurality of undulations is formed across the front surface of the first plate. The plurality of undulations increasing an amount of surface area to contact a projectile.

In accordance with one embodiment, a ballistic panel providing ballistic protection is disclosed. The ballistic panel has a first plate having a rear surface and a front surface. A first plurality of undulations is formed across the front surface of the first plate. The first plurality of undulations increases an amount of surface area to contact a projectile. A second plurality of undulations is formed across the rear surface of the first plate. A second plate has a rear surface and a front surface. A third plurality of undulations is formed across the front surface of the second plate. The third plurality of undulations engage with the second plurality of undulations formed across the rear surface of the first plate to position the rear surface of the first plate against the front surface of the second plate.

In accordance with one embodiment, a ballistic panel providing ballistic protection is disclosed. The ballistic panel has a first plate having a rear surface and a front surface. A first plurality of channels run across the front surface of the first plate. The first plurality of channels increasing an amount of surface area to contact a projectile. A second plurality of channels run across the rear surface of the first plate. A second plate has a rear surface and a front surface. A third plurality of channels runs across the front surface of the second plate. The third plurality of channels engage with the second plurality of channels running across the rear surface of the first plate to position the rear surface of the first plate against the front surface of the second plate.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Embodiments of the exemplary ballistic protection device, system, and method (hereinafter device) employ a deflective technology designed to cause additional surface area of a projectile to make contact with the ballistic protection device. In this way, the present invention can be utilized regardless of material (e.g., steel, ceramic, polyethylene, aluminum, etc.). The exemplary ballistic protection device generally comprises a plate that has an exterior (i.e. projectile facing) surface that is comprised of substantially v-shaped rows utilized to cause more of the surface area of the projectile to come into contact with the plate. The interior facing surface can either be substantially flat or curved or similarly comprised of substantially v-shaped rows.

The V-shape rows may cause the projectile to begin to yaw or be deflected and/or redirected, the result is that an increasing amount of the surface of the projectile is placed into contact with the ballistic protection device. The more surface area of the plate that is able to contact the surface area of the projectile, the more blunt force trauma energy can be dispersed and the more effective that ballistic protection device can be in serving its primary function, preventing a projectile from penetrating and otherwise causing damage to the person or object on the other side.

Figure 1:
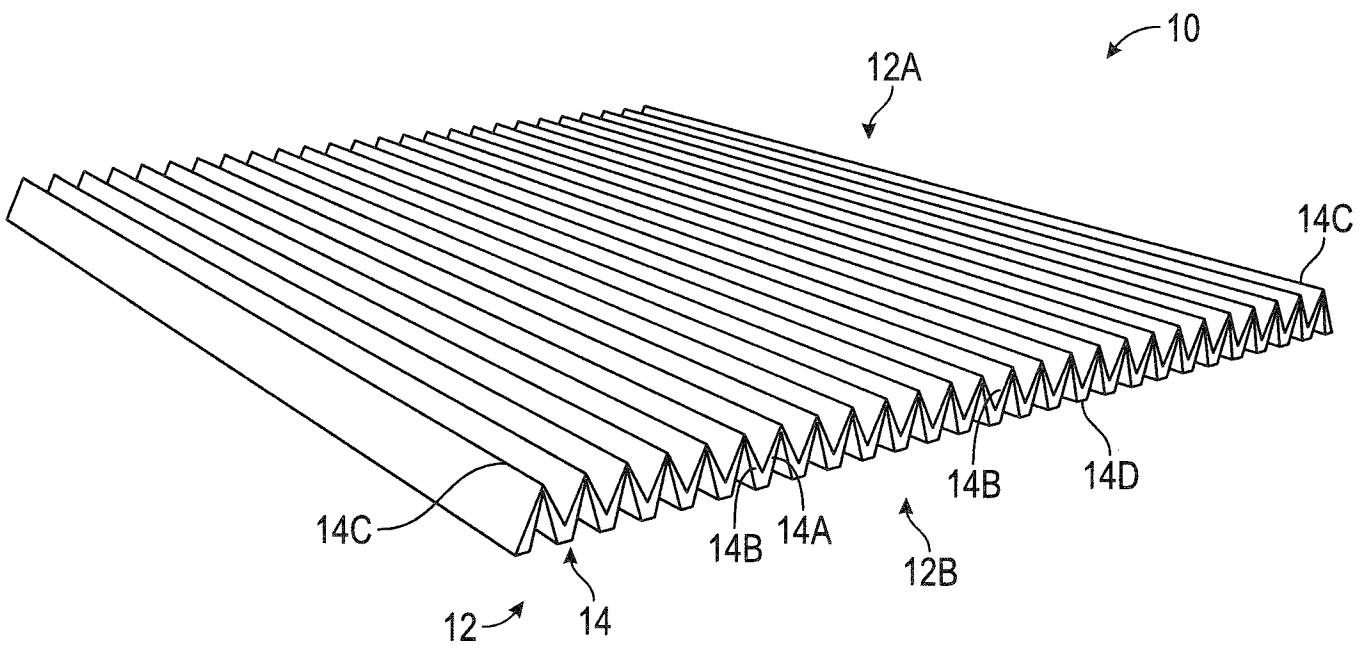
FIG. 1 is an elevated perspective view of an exemplary ballistic protection system having substantially v-shaped ridges in accordance with one aspect of the present application.

Referring to FIG. 1, one exemplary embodiment of a ballistic protection device 10 (hereinafter device 10) may be seen. The device 10 may be comprised of a plate 12 having an exterior facing surface 12A and an interior facing surface 12B. The interior facing surface 12B may be the surface closest to a body of a wearer of the device 10.

The plate 12 may have a plurality of channels 14 formed therein. In the embodiment shown, the channels 14 may be shown run an entire height (vertically) along the plate 12. However, this is shown as one embodiment and the channels 14 may run vertically, horizontally, crisscross, in a curved pattern, or in other designs.

Each channel 14 may be formed of a pair of side walls 14A. In the embodiment shown, the side walls 14A of each channel 14 may be slanted to form "V" shaped channels 14B.

Adjacent "V" shaped channels 14B may be attached to one another. In the embodiment shown, sidewalls 14A of adjacent "V" shaped channels 14B may be attached along a length thereof to form an undulating triangular wave configuration of channels 14. The area where sidewalls 14A of adjacent "V" shaped channels 14B are attached may form a tip 14C of the triangular wave configuration of channels 14, A bottom surface 14D of "V" shaped channels 14B may be flat. This may allow for a more comfortable feel when placed against a body of the wearer. Alternatively, the interior facing surface 12B, may be all substantially flat or curved to provide a more comfortable feel when placed against a body of the wearer.

The undulating triangular wave configuration of channels 14 may cause the projectile to yaw or be deflected and/or redirected, the result is that an increasing amount of a surface of the projectile may be placed into contact with the plate 12. The more surface area of the plate 12 that is able to contact the surface area of the projectile, the more blunt force trauma energy can be dispersed and the more effective that device 10 can be in serving its primary function, preventing a projectile from penetrating and otherwise causing damage to the wearer or object on the other side of the plate 12. It should be noted that the angled and depth of the "V" shaped channels 14B may vary depending on the type of projectile that the plate 12 is designed to stop.

Figure 2:
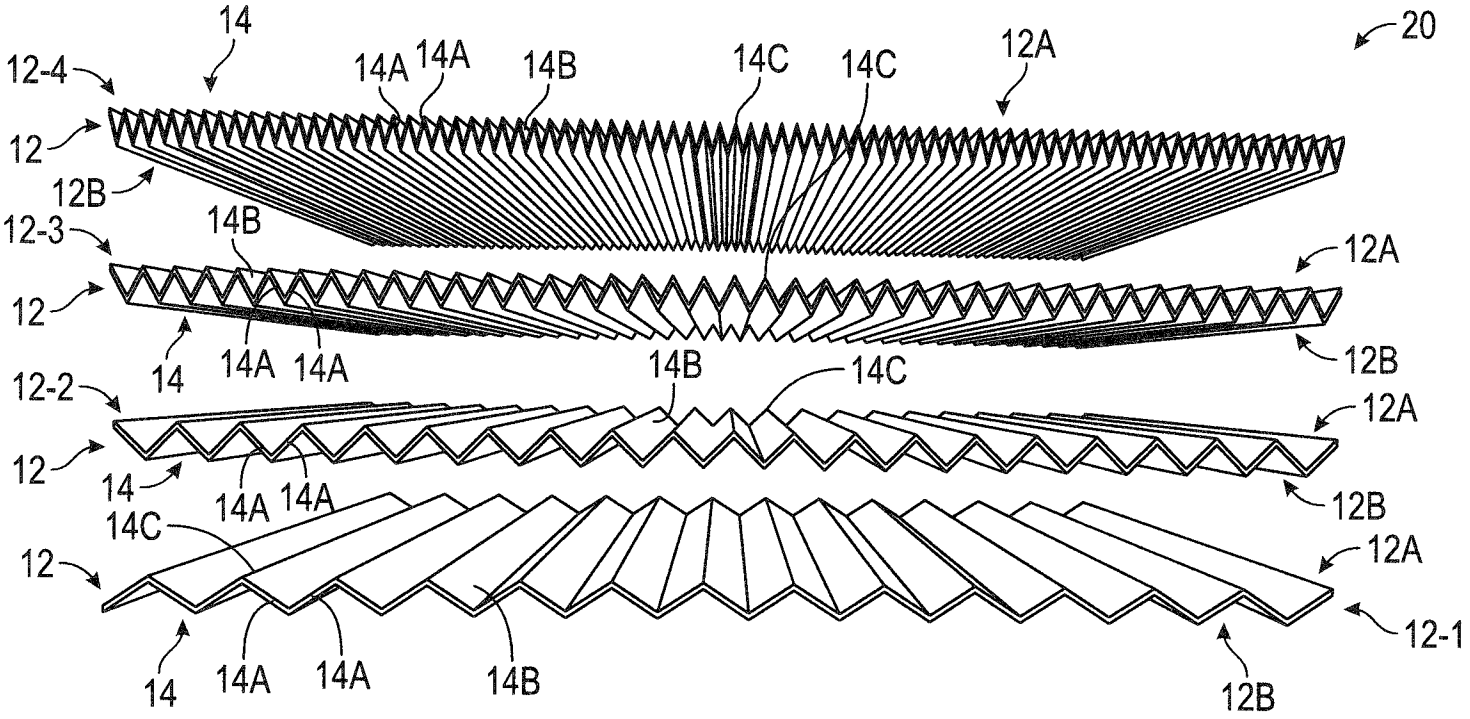
FIG. 2 is a perspective view of an of an exemplary ballistic protection system in which multiple layers of the substantially v-shaped channeled materials can be placed and/or secured to one another in order to create multiple layers for additional protection in accordance with one aspect of the present application.

Referring to FIG. 2, one exemplary embodiment of a ballistic protection device 20 (hereinafter device 20) may be seen. The device 20 may be formed of a plurality of plates 12. Each plate 12 may be layered and positioned against an exterior facing surface 12A or an interior facing surface 12B of an adjacent plate 12. The layering of plates 12 may increase the stopping capability and reduce blunt force trauma caused by a projectile due to the thickness of the layered plates 12 as well as the configuration of the plates 12 which may cause the projectile to yaw or be deflected and/or redirected, the result being that an increasing amount of a surface of the projectile may be placed into contact with the plates 12.

Each plate 12 may have a plurality of channels 14 formed therein. In the embodiment shown, the channels 14 may be shown run an entire height (vertically) along the plate 12. However, this is shown as one embodiment and the channels 14 may run vertically, horizontally, crisscross, in a curved pattern, or in other designs.

Each channel 14 may be formed of a pair of side walls 14A. In the embodiment shown, the side walls 14A of each channel 14 may be slanted to form "V" shaped channels 14B.

Adjacent "V" shaped channels 14B may be attached to one another. In the embodiment shown, sidewalls 14A of adjacent "V" shaped channels 14B may be attached along a length thereof to form an undulating triangular wave configuration of channels 14. The area where sidewalls 14A of adjacent "V" shaped channels 14B are attached may form a tip 14C of the triangular wave configuration of channels 14. While not shown, the interior facing surface 12B of a bottom plate 12 closest to the wearer may have flat sections, to provide a more comfortable feel when placed against the body of the wearer. Alternatively, the interior facing surface 12B, may be all substantially flat or curved to provide a more comfortable feel when placed against a body of the wearer.

The undulating triangular wave configuration of channels 14 may cause the projectile to yaw or be deflected and/or redirected, the result is that an increasing amount of a surface of the projectile may be placed into contact with the plate 12. The more surface area of the plate 12 that is able to contact the surface area of the projectile, the more blunt force trauma energy can be dispersed and the more effective that device 10 can be in serving its primary function, preventing a projectile from penetrating and otherwise causing damage to the wearer or object on the other side of the plate 12. It should be noted that the angled and depth of the "V" shaped channels 14B may vary depending on the type of projectile that the plate 12 is designed to stop.

In the present embodiment, each plate 12 has a differing undulating triangular wave configuration of channels 14. Having differing undulating triangular wave configuration of channels 14 may cause the projectile to yaw or be deflected and/or redirected more if the projectile moves through a first plate 12 to the next since the next plate 12 would have a different undulating triangular wave configuration of channels 14, Thus, as stated above, this may result in an increasing amount of a surface of the projectile may be placed into contact with the plates 12.

Each plate 12 may have a differing undulating triangular wave configuration of channels 14. In the present embodiment, the density of "V" shaped channels 14B increases as the plates 12 move further away from the wearer. In the present embodiment, the bottom plate 12-1, which is closest to the wearer may have "V" shaped channels 14B having side walls 14A at a larger slant than a second plate 12-2 positioned on the exterior facing surface 12A the bottom plate 12-1. Thus, the second plate 12-2 may have narrower "V" shaped channels 14B than the bottom plate 12-1, allowing the second plate 12-2 to have more "V" shaped channels 14B and thus a denser configuration of "V" shaped channels 14B than the bottom plate 12-1. A third plate 12-3 may be positioned on the exterior facing surface 12A the second plate 12-2. The third plate 12-3 may have a denser configuration of "V" shaped channels 14B than both the bottom plate 12-1 and the second plate 12-2. Thus, the third plate 12-3 may have narrower "V" shaped channels 14B than both the bottom plate 12-1 and the second plate 12-2, allowing the third plate 12-2 to have more "V" shaped channels 14B and thus a denser configuration of "V" shaped channels 14B than the bottom plate 12-1 and the second plate 12-2. A fourth plate 12-4 may be positioned on the exterior facing surface 12A of the third plate 12-3. The fourth plate 12-4 may have a denser configuration of "V" shaped channels 14B than the bottom plate 12-1, the second plate 12-2 and the third plate 12-3. Thus, the fourth plate 12-4 may have narrower "V" shaped channels 14B than the bottom plate 12-1, the second plate 12-2 and the third plate 12-3, allowing the fourth plate 12-4 to have more "V" shaped channels 14B and thus a denser configuration of "V" shaped channels 14B than the bottom plate 12-1, the second plate 12-2 and the third plate 12-3. This configuration may continue with each plate 12 having narrower "V" shaped channels 14B than the previous plate 12 upon which it is coupled to the exterior facing surface 12A thereon. While the present embodiment shows four plates 12, more or less plates having this configuration may be used depending on the type of projectile that the device 20 is designed to stop.

Figure 3:
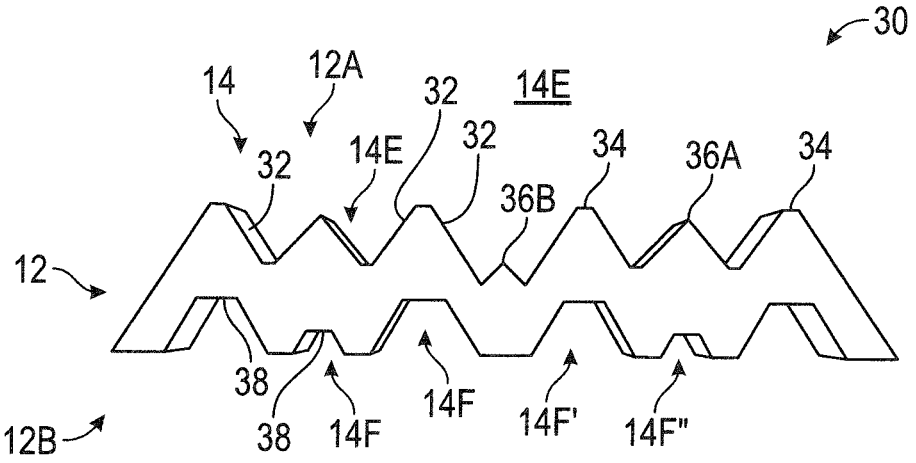
FIG. 3 is a cross-sectional view of an exemplary ballistic protection system having a channel design of varying peaks and valleys in accordance with one aspect of the present application.

Referring to FIG. 3, one exemplary embodiment of a ballistic protection device 30 (hereinafter device 30) may be seen. The device 30 may be comprised of a plate 12 having an exterior facing surface 12A and an interior facing surface 12B. The interior facing surface 12B may be the surface closest to a body of a wearer of the device 10.

The plate 12 may have a plurality of channels 14. In the present embodiment, the channels 14 have differing configurations to fit separate needs. In the embodiment shown, the channels 14 formed on the exterior facing surface 12A may have "W" shaped channels 14E. The end legs 32 of the "W" shaped channels 14E may form a flat horizontal surface 34 with an adjacent and adjoining "W" shaped channels 14E. The "W" shaped channels 14E may have a center tip 36A which is approximately of equal height as the flat horizontal surface 34 or a center tip 36B which rises approximately a quarter of the height up the end legs 32. In the embodiment shown, the "W" shaped channels 14E alternate such that a "W" shaped channels 14E with the center tip 36A is attached to "W" shaped channels ME with the center tip 36B.

In the embodiment shown, the channels 14 formed on the interior facing surface 12B may have trapezoidal shaped channels 14F. The trapezoidal shaped channels 14F may be positioned such that a horizontal bottom floor 38 is positioned under either the flat horizontal surface 34 or the center tip 36A.

The trapezoidal shaped channels 14F may have differing depths. In accordance with one embodiment, a first trapezoidal shaped channel 14F' may have a depth of less than 40% of the thickness of the plate 12 and may be positioned under the flat horizontal surface 34. For example, the first trapezoidal shaped channel 14F' may have a depth of approximately 5 mm and the plate 12 may have a thickness of 13 mm. A second trapezoidal shaped channel 14F" may have a depth of around 15% of the thickness of the plate 12 and may be positioned under the center tip 36A. For example, the trapezoidal shaped channel 14F" may have a depth of approximately 2 mm and the plate 12 may have a thickness of 13 mm.

In the embodiment shown, the channels 14 may be shown run an entire height (vertically) along the plate 12. However, this is shown as one embodiment and the channels 14 may run vertically, horizontally, crisscross, in a curved pattern, or in other designs.

The undulating triangular wave configuration of channels 14 may cause the projectile to yaw or be deflected and/or redirected, the result is that an increasing amount of a surface of the projectile may be placed into contact with the plate 12. The more surface area of the plate 12 that is able to contact the surface area of the projectile, the more blunt force trauma energy can be dispersed and the more effective that device 10 can be in serving its primary function, preventing a projectile from penetrating and otherwise causing damage to the wearer or object on the other side of the plate 12. It should be noted that the angled and depth of the "W" shaped channels 14E may vary depending on the type of projectile that the plate 12 is designed to stop.

Figure 4:
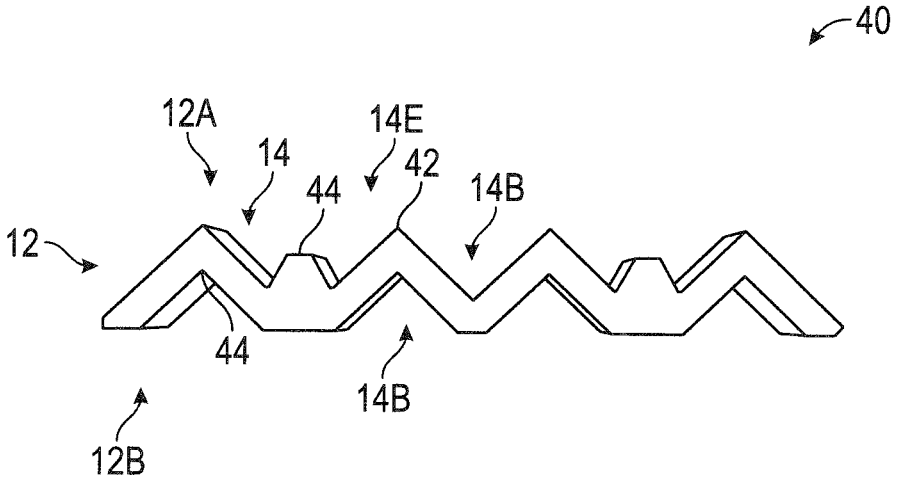
FIG. 4 is a cross-sectional view of an exemplary ballistic protection system having a channel design of varying peaks and valleys and may be dimensioned to be coupled proximate to the system shown in FIG. 3 in accordance with one aspect of the present application.

Referring to FIG. 4, one exemplary embodiment of a ballistic protection device 40 (hereinafter device 40) may be seen. The device 40 may be comprised of a plate 12 having an exterior facing surface 12A and an interior facing surface 12B. The interior facing surface 12B may be the surface closest to a body of a wearer of the device 10.

Figure 5:
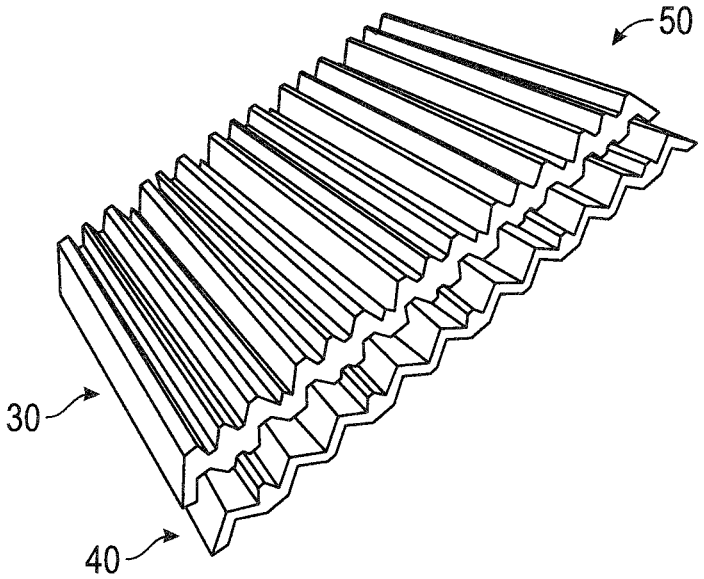
FIG. 5 is a cross-sectional view of an exemplary ballistic protection system combining multiple plates having channel designs of varying peaks and valleys in accordance with one aspect of the present application.
Figure 6:
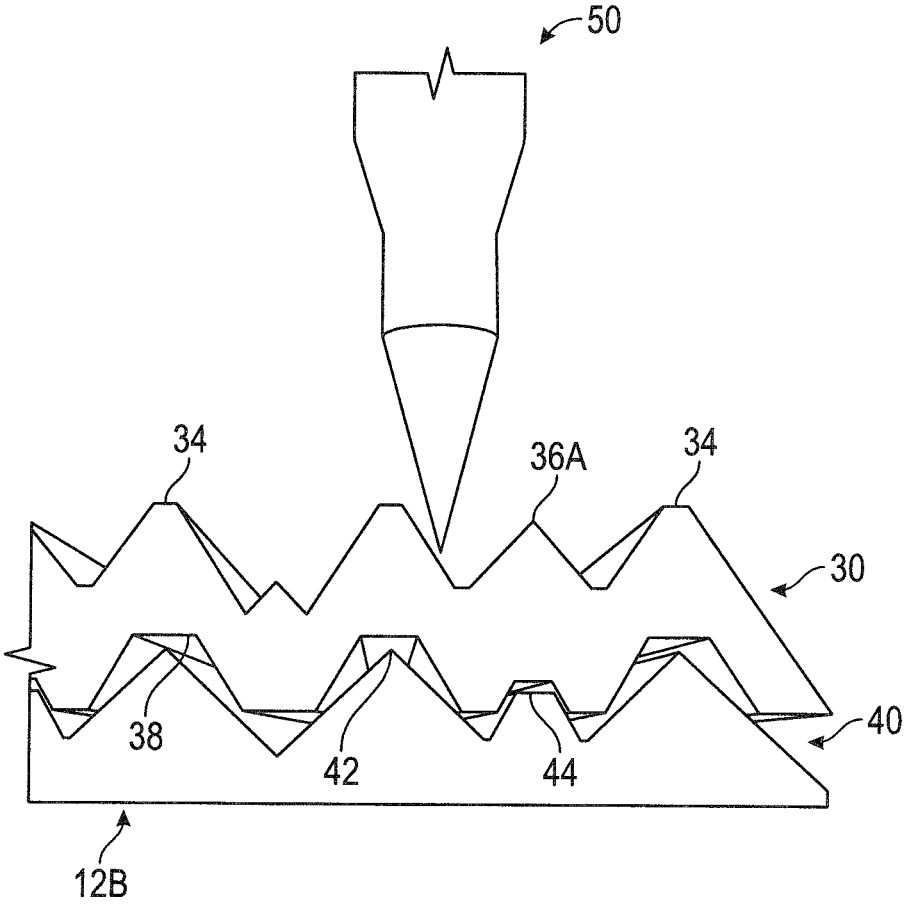
FIG. 6 is a perspective view of the exemplary ballistic protection system combining multiple plates having channel designs of varying peaks and valleys in accordance with one aspect of the present application.

The plate 12 may have a plurality of channels 14. In the present embodiment, the channels 14 have differing configurations to fit separate needs. In the embodiment shown, the channels 14 formed on the exterior facing surface 12A may be a combination of "V" shaped channels 14B and "W" shaped channels 14E. In the present embodiment, the channels 14 may alternate between the "V" shaped channels 14B and "W" shaped channels 14E. A tip 42 may be formed where the "V" shaped channels 14B connects with the "W" shaped channels 14E. The "W" shaped channels 14E may have a trapezoidal shaped center area 44. The trapezoidal shaped center area 44 may be shaped and sized to fit within the trapezoidal shaped channels 14F" when the interior facing surface 12B of device 30 is placed on top of the exterior facing surface 12A of device 40 as shown in FIGS. 5-6. In the embodiment shown, the channels 14 formed on the interior facing surface 12B may have "V" shaped channels 14B. A tip 44 of each "V" shaped channels 14B may be aligned with the tip 42.

In the embodiment shown, the channels 14 may be shown run an entire height (vertically) along the plate 12. However, this is shown as one embodiment and the channels 14 may run vertically, horizontally, crisscross, in a curved pattern, or in other designs.

The undulating triangular wave configuration of channels 14 may cause the projectile to yaw or be deflected and/or redirected, the result is that an increasing amount of a surface of the projectile may be placed into contact with the plate 12. The more surface area of the plate 12 that is able to contact the surface area of the projectile, the more blunt force trauma energy can be dispersed and the more effective that device 10 can be in serving its primary function, preventing a projectile from penetrating and otherwise causing damage to the wearer or object on the other side of the plate 12. It should be noted that the angled and depth of the "W" shaped channels 14E may vary depending on the type of projectile that the plate 12 is designed to stop.

Referring to FIG. 5, a device 50 may be seen wherein the interior facing surface 12B of device 30 is placed on top of the exterior facing surface 12A of device 40. In FIG. 5, the trapezoidal shaped center area 44 may be shaped and sized to fit within the trapezoidal shaped channels 14F". The tip 42 may be sized to fit within the trapezoidal shaped channels 14F'.

Referring to FIG. 6, a device 60 may be seen wherein the interior facing surface 12B of device 30 is placed on top of the exterior facing surface 12A of device 40. In FIG. 6, the trapezoidal shaped center area 44 may be shaped and sized to fit within the trapezoidal shaped channels 14F". The tip 42 may be sized to fit within the trapezoidal shaped channels 14F'. In FIG. 6, the interior facing surface 12B of device 40, which would be closest to the wearer, is substantially flat to provide a more comfortable feel to the wearer.

The foregoing description is illustrative of particular embodiments of the application, but is not meant to be a limitation upon the practice thereof. The following claims, including all equivalents thereof, are intended to define the scope of the application.

What is claimed is:

1. A ballistic panel providing ballistic protection comprising:

a first plate having a rear surface and a front surface;

a plurality of undulations formed across the front surface of the first plate, the plurality of undulations increasing an amount of surface area to contact a projectile, wherein the plurality of undulations comprises a plurality "W" shaped channels running across the front surface of the first plate; and a plurality of channels formed on the rear surface of the first plate, wherein the plurality of channels formed on the rear surface of the first plate are trapezoidal in shape.

2. The ballistic panel of claim 1, wherein adjacent "W" shaped channels have a center tip of different heights.

3. The ballistic panel of claim 1, wherein the plurality of undulations comprises a combination of altering "W" shaped channels and "V" shaped channels running across the front surface of the first plate.

4. The ballistic panel of claim 3, wherein the "W" shaped channels have a trapezoidal center member.

5. The ballistic panel of claim 2, comprising:

a second plate having a rear surface and a front surface; and a plurality of channels formed on the front surface of the second plate, the plurality of channels on the front surface of the second plate engaging the plurality of channels on the rear surface of the first plate.

6. The ballistic panel of claim 1, wherein a density of the plurality of channels formed on the front surface of the second plate is less than the plurality of channels formed on the rear surface of the first plate.

7. A ballistic panel providing ballistic protection comprising:

a first plate having a rear surface and a front surface;

a first plurality of undulations formed across the front surface of the first plate, the first plurality of undulations increasing an amount of surface area to contact a projectile;

a second plurality of undulations formed across the rear surface of the first plate;

a second plate having a rear surface and a front surface; and a third plurality of undulations formed across the front surface of the second plate, wherein the third plurality of undulations engage with the second plurality of undulations formed across the rear surface of the first plate to position the rear surface of the first plate against the front surface of the second plate;

wherein the first plurality of undulations are a plurality "W" shaped channels running across the front surface of the first plate, the second plurality of undulations are trapezoidal shaped channels running across the rear surface of the first plate, the third plurality of undulations engaging the trapezoidal shaped channels on the rear surface of the first plate.

8. A ballistic panel providing ballistic protection comprising:

a first plate having a rear surface and a front surface;

a first plurality of undulations formed across the front surface of the first plate, the first plurality of undulations increasing an amount of surface area to contact a projectile;

a second plurality of undulations formed across the rear surface of the first plate;

a second plate having a rear surface and a front surface; and a third plurality of undulations formed across the front surface of the second plate, wherein the third plurality of undulations engage with the second plurality of undulations formed across the rear surface of the first plate to position the rear surface of the first plate against the front surface of the second plate;

wherein the first plurality of undulations are a plurality "W" shaped channels running across the front surface of the first plate, the second plurality of undulations are trapezoidal shaped channels running across the rear surface of the first plate, and the third plurality of undulations are a combination of altering "W" shaped channels and "V" shaped channels running across the front surface of the first plate and engaging the trapezoidal shaped channels on the rear surface of the first plate.

* * * * *